US009359654B2

(12) United States Patent
Katsumata et al.

(10) Patent No.: US 9,359,654 B2
(45) Date of Patent: Jun. 7, 2016

(54) MIST COOLING APPARATUS AND HEAT TREATMENT APPARATUS

(75) Inventors: Kazuhiko Katsumata, Saitama (JP); Ami Ueda, Tokyo (JP); Shinya Kudo, Tokyo (JP); Takahisa Shimada, Kakamigahara (JP)

(73) Assignees: IHI CORPORATION (JP); IHI MACHINERY AND FURNACE CO., LTD. (JP)

( * ) Notice: Subject to any disclaimer, the term of this patent is extended or adjusted under 35 U.S.C. 154(b) by 262 days.

(21) Appl. No.: 13/640,135

(22) PCT Filed: Apr. 12, 2011

(86) PCT No.: PCT/JP2011/059105

§ 371 (c)(1),
(2), (4) Date: Oct. 9, 2012

(87) PCT Pub. No.: WO2011/129340

PCT Pub. Date: Oct. 20, 2011

(65) Prior Publication Data

US 2013/0032977 A1 Feb. 7, 2013

(30) Foreign Application Priority Data

Apr. 12, 2010 (JP) ..... P2010-091362

(51) Int. Cl.
*C21D 1/62* (2006.01)
*C21D 1/667* (2006.01)
(Continued)

(52) U.S. Cl.
CPC *C21D 1/667* (2013.01); *C21D 1/74* (2013.01); *C21D 9/0043* (2013.01);
(Continued)

(58) Field of Classification Search
CPC ..... C21D 1/667; C21D 1/74; C21D 9/0043; C21D 9/0062; F27B 2005/062; F27B 5/02; F27D 15/02; F27D 2009/0075; F27D 2009/0081; F27D 7/02; F27D 9/00
USPC ..... 266/114, 46, 259; 432/81, 82, 85, 77, 432/206
See application file for complete search history.

(56) References Cited

U.S. PATENT DOCUMENTS 3,300,198 A * 1/1967 Clumpner et al. ..... 134/64 R
4,024,903 A * 5/1977 Yamada ..... C21B 7/10 122/7 R
2011/0262877 A1* 10/2011 Katsumata ..... 432/77

FOREIGN PATENT DOCUMENTS

CN 201111966 Y 9/2008
JP 53-065224 6/1978
(Continued)

OTHER PUBLICATIONS

Chinese Office Action, dated May 21, 2014, issued in corresponding to Chinese Patent Application No. 201180019045.8, filed Apr. 12, 2011, including English translation. Total 17 pages.
(Continued)

*Primary Examiner* — Scott Kastler
*Assistant Examiner* — Michael Aboagye
(74) *Attorney, Agent, or Firm* — Ostrolenk Faber LLP

(57) ABSTRACT

The mist cooling apparatus (3) includes: a cooling system (30) which includes a nozzle (35, 35A) that sprays cooling liquid in a form of a mist onto a treatment object which has been heated and provided in a cooling furnace (10), and a pump (33) that is driven by a drive source and thereby makes the cooling liquid flow toward the nozzle (35, 35A); and a second cooling system (40) which operates in response to a stoppage of the drive source, and thereby cools the treatment object.

1 Claim, 5 Drawing Sheets

(51) Int. Cl.

| | |
|---|---|
| ***C21D 1/74*** | (2006.01) |
| ***C21D 9/00*** | (2006.01) |
| ***F27B 5/02*** | (2006.01) |
| ***F27D 7/02*** | (2006.01) |
| ***F27D 9/00*** | (2006.01) |
| ***F27D 15/02*** | (2006.01) |
| *F27B 5/06* | (2006.01) |

(52) U.S. Cl.

CPC ..... *C21D 9/0062* (2013.01); *F27B 5/02* (2013.01); *F27D 7/02* (2013.01); *F27D 9/00* (2013.01); *F27D 15/02* (2013.01); *F27B 2005/062* (2013.01); *F27D 2009/0075* (2013.01); *F27D 2009/0081* (2013.01)

(56) References Cited

FOREIGN PATENT DOCUMENTS

| | | | | |
|---|---|---|---|---|
| JP | 57-092733 | | 6/1982 | |
| JP | 01-230986 | | 9/1989 | |
| JP | 01230896 | * | 9/1989 | ..... F27D 9/00 |
| JP | 11-153386 | | 6/1999 | |
| JP | 2005-074355 | | 3/2005 | |
| WO | WO 2010/005083 | | 1/2010 | |
| WO | WO 2010005083 | * | 1/2010 | ..... F27D 9/00 |

OTHER PUBLICATIONS

Chen Naixiang, et al., "Centrifugal Pump" *China Machine Press*, p. 79 (May 2003), including English Abstract.

Japanese Office Action, dated Sep. 10, 2013, issued in corresponding Japanese Application No. 2010-091362. English translation included. Total 19 pages.

International Search Report and Written Opinion mailed Jul. 5, 2011 in corresponding PCT International Application No. PCT/JP2011/059105.

Japanese Notice of Allowance, dated Jan. 28, 2014, issued in corresponding Japanese Patent Application No. 2010-091362. Total 6 pages. Including English translation.

* cited by examiner

MIST COOLING APPARATUS AND HEAT TREATMENT APPARATUS

CROSS-REFERENCE TO RELATED APPLICATIONS

The present application is a 35 U.S.C. §§371 national phase conversion of PCT/JP2011/059105, filed Apr. 12, 2011, which claims priority of Japanese Patent Application No. 2010-091362, filed Apr. 12, 2010, the contents of which are incorporated herein by reference. The PCT International Application was published in the Japanese language.

TECHNICAL FIELD

The present invention relates to a mist cooling apparatus and a heat treatment apparatus.

BACKGROUND ART

In Japanese Patent Application, First Publication No. H11-153386, a mist cooling apparatus is disclosed that is used in heat treatment on a treatment object such as a metallic material, and cools the treatment object. The mist cooling apparatus sprays mist-like cooling liquid onto the heated treatment object and performs cooling by using the latent heat of vaporization of the cooling liquid. For this reason, the cooling ability of the mist cooling apparatus is higher than a gas spray type cooling apparatus in the related art. Further, by adjusting the amount of sprayed mist, it is possible to easily perform control of the cooling rate of the treatment object, which has been difficult in an immersion type cooling apparatus in the related art.

SUMMARY OF INVENTION

Technical Problem

In the immersion type cooling apparatus in the related art, since the heated treatment object is immersed in cooling liquid, even if the apparatus is stopped due to a power failure or the like, cooling continues. Accordingly, the possibility that the apparatus is damaged by heat of the treatment object is low. On the other hand, in the mist cooling apparatus, cooling liquid is caused to flow using a pump or the like, and then the cooling liquid is sprayed in a form of mist from a spray nozzle. For this reason, if the apparatus is stopped due to a power failure or the like, spraying of mist is also stopped, so that the temperature and pressure in the inside of the apparatus may rise due to heat of the treatment object, whereby there is a possibility that the apparatus is damaged.

The present invention has been made in view of the above-described points and has an object of providing a mist cooling apparatus and a heat treatment apparatus, in which in a time of emergency such as a power failure, damage to the apparatuses due to heat of a treatment object can be prevented.

Solution to Problem

In order to solve the above problem, the invention adopts the following means.

According to an aspect of the present invention, a mist cooling apparatus includes: a cooling system which includes a nozzle that sprays cooling liquid in a form of mist onto a treatment object which has been heated and provided in a cooling furnace, and a pump that is driven by a drive source and thereby makes the cooling liquid flow toward the nozzle;

and a second cooling system which operates in response to a stoppage of the drive source, and thereby cools the treatment object.

According to the aspect of the present invention, if the drive source is stopped, so that cooling of the treatment object by the cooling system is stopped, the second cooling system operates, so that cooling of the treatment object is continued.

Further, the pump may be driven by electric power, and the second cooling system may include an emergency power supply to drive the pump in response to an outage of the electric power.

In this case, if supply of the electric power is stopped, so that cooling of the treatment object by the cooling system is stopped, the pump is driven by the emergency power supply, so that cooling of the treatment object is continued.

Further, the cooling system may include two or more nozzles, and the second cooling system may include a valve which is provided between the pump and a nozzle located over the treatment object among the two or more nozzles, and the valve which adopts an opened state at least during an outage of the electric power.

In this case, if supply of the electric power is stopped, the valve adopts the opened state. Accordingly, the cooling liquid is supplied into the cooling furnace from the nozzle which is located over the treatment object.

Further, the cooling system may include two or more pumps, and the emergency power supply may drive a specific pump among the two or more pumps.

In this case, if supply of the electric power is stopped, so that cooling of the treatment object by the cooling system is stopped, the specific pump is driven by the emergency power supply, so that cooling of the treatment object is continued. Accordingly, it becomes possible to limit the capacity of the emergency power supply to a capacity sufficient to drive the specific pump.

Further, the second cooling system may include a storage tank which is provided further to the upper side than the cooling furnace and stores cooling liquid, and a second valve which is provided between the storage tank and the nozzle and adopts an opened state at least during a stoppage of the drive source.

In this case, if the drive source is stopped, so that cooling of the treatment object by the cooling system is stopped, the second valve adopts the opened state. Accordingly, the cooling liquid is supplied into the cooling furnace through the nozzle from the storage tank which is provided further to the upper side than the cooling furnace.

Further, the cooling system may include two or more nozzles, and the second valve may be provided between the storage tank and a nozzle that is located over the treatment object among the two or more nozzles.

In this case, if the drive source is stopped, the second valve adopts the opened state. Accordingly, the cooling liquid is supplied into the cooling furnace from the nozzle that is located over the treatment object.

Further, a heat treatment apparatus that performs heat treatment on the treatment object may include the mist cooling apparatus according to the above-described aspect of the present invention.

In this case, if the drive source is stopped, so that cooling of the treatment object by the cooling system is stopped, the second cooling system operates, so that cooling of the treatment object is continued.

Effects of Invention

According to the present invention, even if the drive source is stopped, so that cooling of the treatment object by the cooling system is stopped, the second cooling system operates, so that it is possible to proceed with cooling of the treatment object. Consequently, in a time of emergency such as a stoppage of the drive source, damage to the apparatus due to heat of the treatment object can be prevented.

DESCRIPTION OF EMBODIMENTS

Hereinafter, embodiments of the present invention are described with reference to FIGS. 1 to 5. In addition, in each drawing which is used in the following description, in order to show each member at a recognizable size, the scale of each member is appropriately changed. Further, in the following description, a two-chamber type heat treatment apparatus is described.

[First Embodiment]

Figure 1:
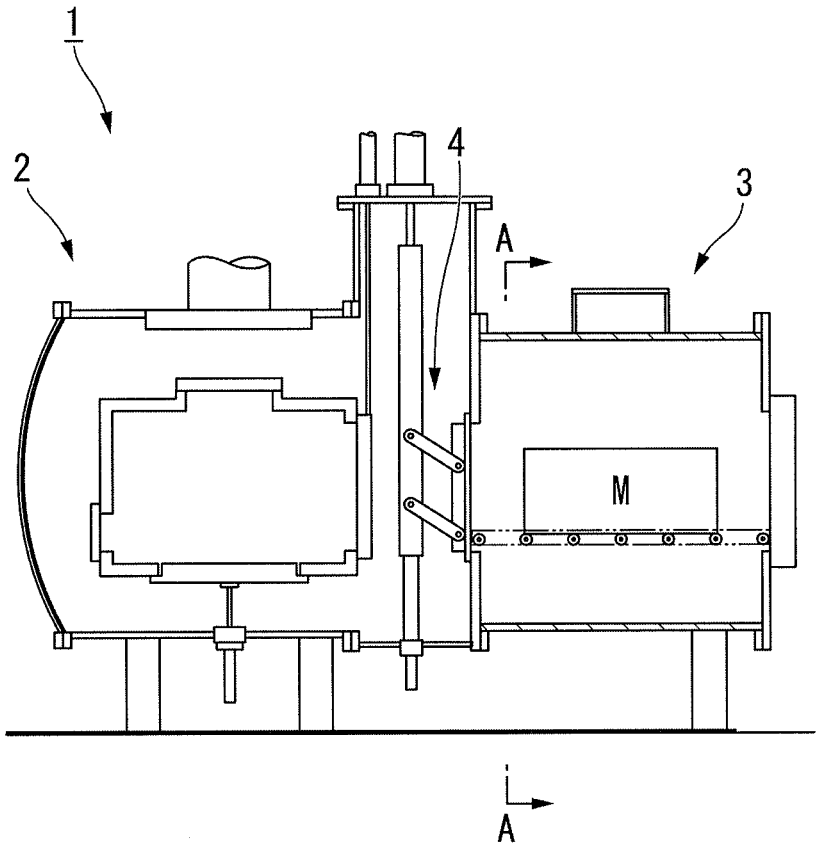
FIG. 1 is an overall configuration diagram of a heat treatment apparatus in a first embodiment of the present invention.

FIG. 1 is an overall configuration diagram of a heat treatment apparatus 1 in this embodiment.

The heat treatment apparatus 1 performs heat treatment such as quenching on a treatment object M. The heat treatment apparatus 1 includes a heating chamber 2 and a cooling chamber (a mist cooling apparatus) 3. The heating chamber 2 and the cooling chamber 3 are disposed adjacently. A partition wall 4 is provided between the heating chamber 2 and the cooling chamber 3. At the time when the partition wall 4 opened, the treatment object M that has been heated in the heating chamber 2 is moved to the cooling chamber 3, and the treatment object M is cooled in the cooling chamber 3.

The treatment object M is subjected to heat treatment by the heat treatment apparatus 1. The treatment object M is made of metallic material (including alloy) such as steel containing a given amount of carbon. In each drawing which is used in the following description, the treatment object M is shown in a rectangular parallelepiped shape; however, various shapes, sizes, and number of treatment object(s) to be treated at a time, or the like may also be used.

Next, the cooling chamber 3 is described with reference to FIG. 2.

Figure 2:
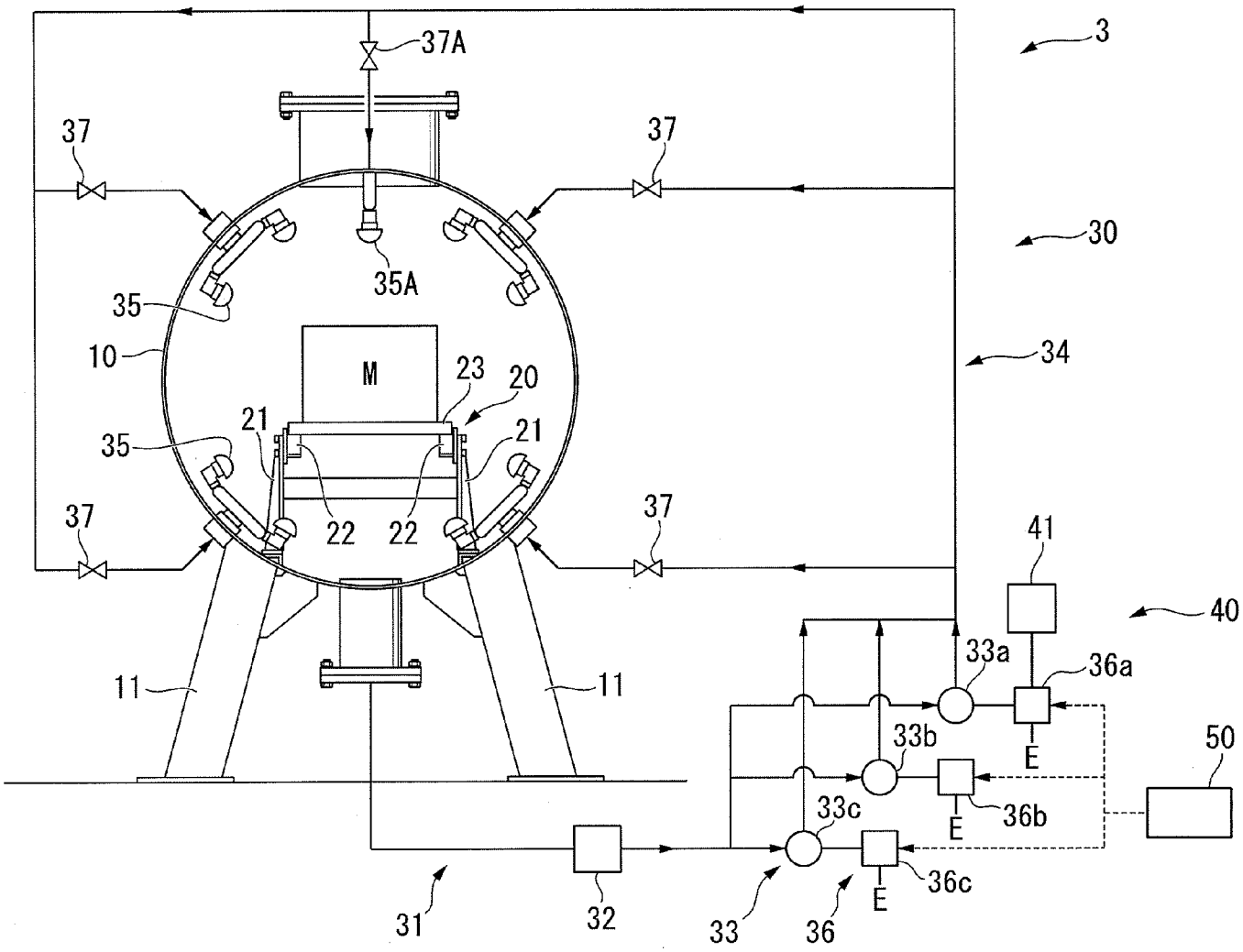
FIG. 2 is a schematic diagram of a cooling chamber in the first embodiment of the present invention, which is a cross-sectional view of FIG. 1 as viewed from section line A-A of FIG. 1.

FIG. 2 is a schematic diagram of the cooling chamber 3 in this embodiment. In addition, the cooling chamber 3 in FIG. 2 is a cross-sectional view as viewed from section line A-A of FIG. 1.

The cooling chamber 3 includes a container (a cooling furnace) 10, a transport part 20, a cooling system 30, a second cooling system 40, and a control part 50.

The container 10 is an approximately cylindrical container being an outer shell of the cooling chamber 3 and being capable of forming a hermetically-sealed space in the inside thereof. The container 10 is installed on a floor surface by a plurality of supporting legs 11.

The transport part 20 transports the treatment object M from the heating chamber 2 into the cooling chamber 3 and transports the treatment object M from the cooling chamber 3 to the outside. The transport part 20 transports the treatment object M in a direction parallel to the central axis of the container 10. The transport part 20 includes a pair of supporting frames 21, a plurality of transport rollers 22, and a drive part (not shown).

The pair of supporting frames 21 is erected on a bottom portion of the inside of the container 10 and supports the treatment object M from below through the plurality of transport rollers 22. The pair of supporting frames 21 is provided so as to extend in a transport direction of the treatment object M. The plurality of transport rollers 22 rotates, thereby smoothly transporting the treatment object M. The plurality of transport rollers 22 is rotatably provided at given intervals in the transport direction on facing surfaces to each other of the pair of supporting frames 21. The drive part (not shown) rotates the transport rollers 22. Further, the treatment object M in this embodiment is not directly placed on the transport rollers 22, but is placed on the transport rollers 22 through a tray 23.

The cooling system 30 sprays cooling liquid in a form of mist onto the treatment object M that has been heated and provided in the container 10, and thereby cools the treatment object M. The cooling system 30 includes a recovery pipe 31, a heat exchanger 32, pumps 33, a supply pipe 34, and nozzles 35.

In addition, as the cooling liquid which is used, for example, water, oil, salt, fluorine-based inert liquid, or the like can be used.

The recovery pipe 31 is a pipe member that recovers the cooling liquid supplied into the container 10. In addition, the cooling liquid when being recovered to the recovery pipe 31 has been heated by heat of the treatment object M. The heat exchanger 32 cools the recovered cooling liquid.

After recovering the cooling liquid from the inside of the container 10 and introducing it into the recovery pipe 31, the pumps 33 discharge the cooling liquid into the supply pipe 34, and make the cooling liquid flow toward the nozzle 35. In addition, as a plurality of pumps 33 is used in this embodiment, three pumps, that is, a first pump (a specific pump) 33*a*, a second pump 33*b*, and a third pump 33*c*, are provided. The first pump 33*a*, the second pump 33*b*, and the third pump 33*c* are disposed in parallel with respect to the supply pipe 34. The plurality of pumps 33 is disposed in parallel, whereby it is possible to produce a large flow rate which is not produced in a single pump, and it becomes possible to widely set an adjustment range of a flow rate of the cooling liquid in the cooling system 30.

An inverter 36 is connected to each of the plurality of pumps 33. That is, a first inverter 36*a*, a second inverter 36*b*, and a third inverter 36*c* are respectively connected to the first pump 33*a*, the second pump 33*b*, and the third pump 33*c*. The inverters 36 drive the pumps 33 in accordance with control instructions of the control part 50 (described later). A drive source of the pumps 33 is electric power E, and the electric power E is supplied to the inverters 36.

The supply pipe 34 is a pipe member which first gathers the cooling liquid discharged from the plurality of pumps 33 and then supplies the cooling liquid to each of a plurality of nozzles 35 (described later).

The nozzles 35 spray the cooling liquid in the form of mist onto the treatment object M that has been heated and provided in the container 10, so as to cool the treatment object M. The plurality of nozzles 35 is provided on an inner wall of the container 10 so as to surround the treatment object M. For this reason, a portion of the treatment object M which does not contact mist becomes small, so that the treatment object M can be uniformly cooled and occurrence of deformation or the like of the treatment object M due to non-uniformity of cooling can be prevented or suppressed. Further, an upper nozzle 35A is provided above the upper side of the treatment object M in a vertical direction with respect to the treatment object M.

A plurality of valves 37 is respectively provided at portions in the supply pipe 34 connected to the plurality of nozzles 35. Each valve 37 is a normally closed type valve which is operated by the electric power E and adopts a closed state when supply of the electric power E is stopped.

On the other hand, an emergency valve 37A is provided at a portion in the supply pipe 34 connected to the upper nozzle 35A. The emergency valve 37A is a normally open type valve which is operated by the electric power E and adopts an opened state when supply of the electric power E is stopped, differently from the plurality of valves 37.

The second cooling system 40 supplies the cooling liquid onto the heated treatment object M when supply of the electric power E that drives the cooling system 30 is stopped, and thereby cools the treatment object M. The second cooling system 40 includes a battery (an emergency power supply) 41 and the emergency valve 37A.

The battery 41 is a drive source that is connected to only the first inverter 36*a* and that drives only the first pump 33*a* in a time of emergency such as an outage of the electric power E. In addition, in place of the battery 41, an emergency power supply device using an internal combustion engine or the like may also be used.

The control part 50 controls driving of the pumps 33 through the inverters 36. The control part 50 can individually control driving of the plurality of pumps 33 and can also drive only a specific pump 33. Since the control part 50 is driven by the electric power E, in a case where there is a need to control driving of the first pump 33*a* by the control part 50 at the time of an outage of the electric power E, the electric power of the battery 41 may also be supplied to the control part 50.

Hereinafter, a cooling operation of the cooling chamber 3 on the treatment object M in this embodiment is described.

First, a cooling operation of the cooling system 30 on the treatment object M is described with reference to FIGS. 1 and 2.

The treatment object M is heated in the heating chamber 2. After heating in the heating chamber 2 is ended, the partition wall 4 is opened and the heated treatment object M is transported into the cooling chamber 3 by driving of the transport part 20.

After transporting into the cooling chamber 3 is ended, the cooling system 30 starts cooling of the treatment object M. The control part 50 controls driving of the pumps 33 through the inverters 36 such that the cooling liquid is discharged into the supply pipe 34. The cooling liquid flows toward the nozzles 35 in the supply pipe 34 and is sprayed in the form of mist toward the treatment object M from the nozzles 35. Mist, which contacts the heated treatment object M, vaporizes while taking the latent heat of vaporization out of the treatment object M. By using the latent heat of vaporization of the cooling liquid, it is possible to rapidly cool the treatment object M.

The vaporized cooling liquid is liquefied again in a liquefaction trap (not shown) or the like and flows into the recovery pipe 31. The cooling liquid which flows in the recovery pipe 31 is cooled by the heat exchanger 32 and discharged into the supply pipe 34 again by the pumps 33.

The cooling liquid flows and circulates in the cooling system 30, whereby the treatment object M can be continuously cooled.

Next, a cooling operation on the treatment object M by the second cooling system 40 when supply of the electric power E that operates the cooling system 30 is stopped is described with reference to FIG. 3.

Figure 3:
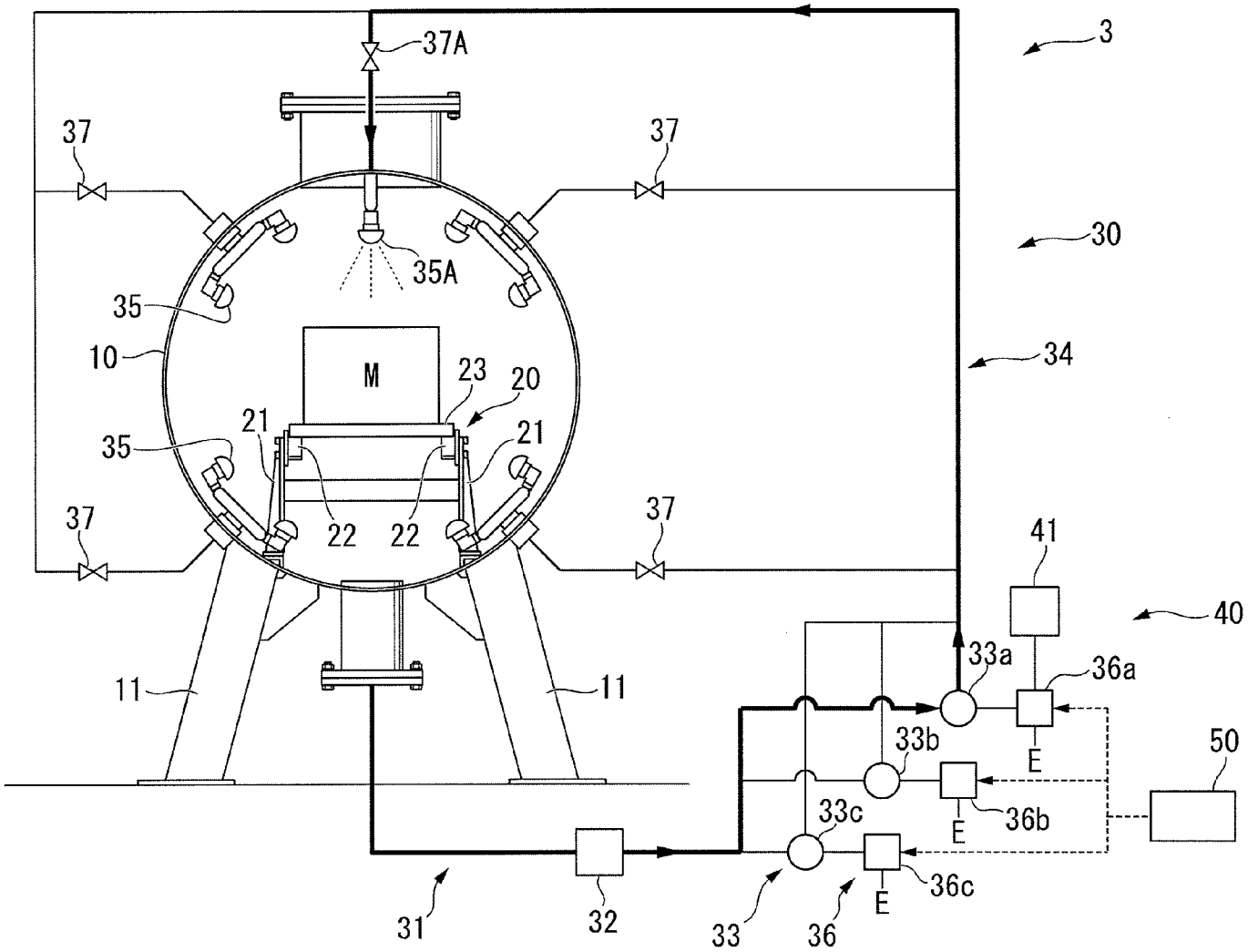
FIG. 3 is a schematic diagram showing an operation of a second cooling system in the first embodiment of the present invention.

FIG. 3 is a schematic diagram showing an operation of the second cooling system 40 in this embodiment. In addition, in the recovery pipe 31 and the supply pipe 34 shown in FIG. 3, only portions in which the cooling liquid flows during operation of the second cooling system 40 are shown by thick lines.

If supply of the electric power E is stopped, the second pump 33*b* and the third pump 33*c* are stopped. On the other hand, the battery 41 is connected to the first inverter 36*a* which is connected to the first pump 33*a*. For this reason, even if supply of the electric power E is stopped, the first pump 33*a* can be driven by supply of electric power from the battery 41. Further, since the battery 41 drives only the first pump 33*a*, the capacity of the battery 41 can be limited to a capacity sufficient to drive the first pump 33*a*, and thus it is possible to reduce the cost for installing the second cooling system 40.

The first pump 33*a* continues to be driven by supply of electric power from the battery 41. Since the plurality of valves 37 provided in the supply pipe 34 are normally closed type valves, all the valves 37 adopt closed states due to an outage of the electric power E. Therefore, flows of the cooling liquid toward the nozzles 35 are blocked by the valves 37, so that supply of the cooling liquid from the nozzles 35 is stopped.

On the other hand, since the emergency valve 37A is a normally open type valve, the emergency valve 37A adopts an opened state due to an outage of the electric power E. That is, the cooling liquid is supplied from the supply pipe 34 through the emergency valve 37A only to the upper nozzle 35A. By making it possible to supply the cooling liquid from only the specific upper nozzle 35A among the plurality of nozzles provided in the cooling chamber 3, even in a case where the battery 41 drives only the first pump 33*a*, the pressure required for spraying mist from the upper nozzle 35A can be applied to the cooling liquid, so that it is possible to sufficiently spray the cooling liquid in the form of mist from the upper nozzle 35A.

Further, since the upper nozzle 35A is provided above the upper side of the treatment object M in the vertical direction with respect to the treatment object M, even in a case where the flow rate of the cooling liquid is small, the cooling liquid can be reliably supplied to the treatment object M. Accordingly, the cooling liquid is supplied toward the treatment object M from the upper nozzle 35A, so that cooling of the heated treatment object M is continued.

Therefore, according to this embodiment, the following effects can be obtained.

According to this embodiment, even if supply of the electric power E is stopped, so that cooling of the treatment object M by the cooling system 30 is stopped, the second cooling system 40 operates, so that it is possible to proceed with cooling of the treatment object M. Consequently, in a time of emergency such as an outage of the electric power E, damage to the cooling chamber 3 due to heat of the treatment object M can be prevented.

[Second Embodiment]

A cooling chamber 3A in this embodiment is described with reference to FIG. 4.

Figure 4:
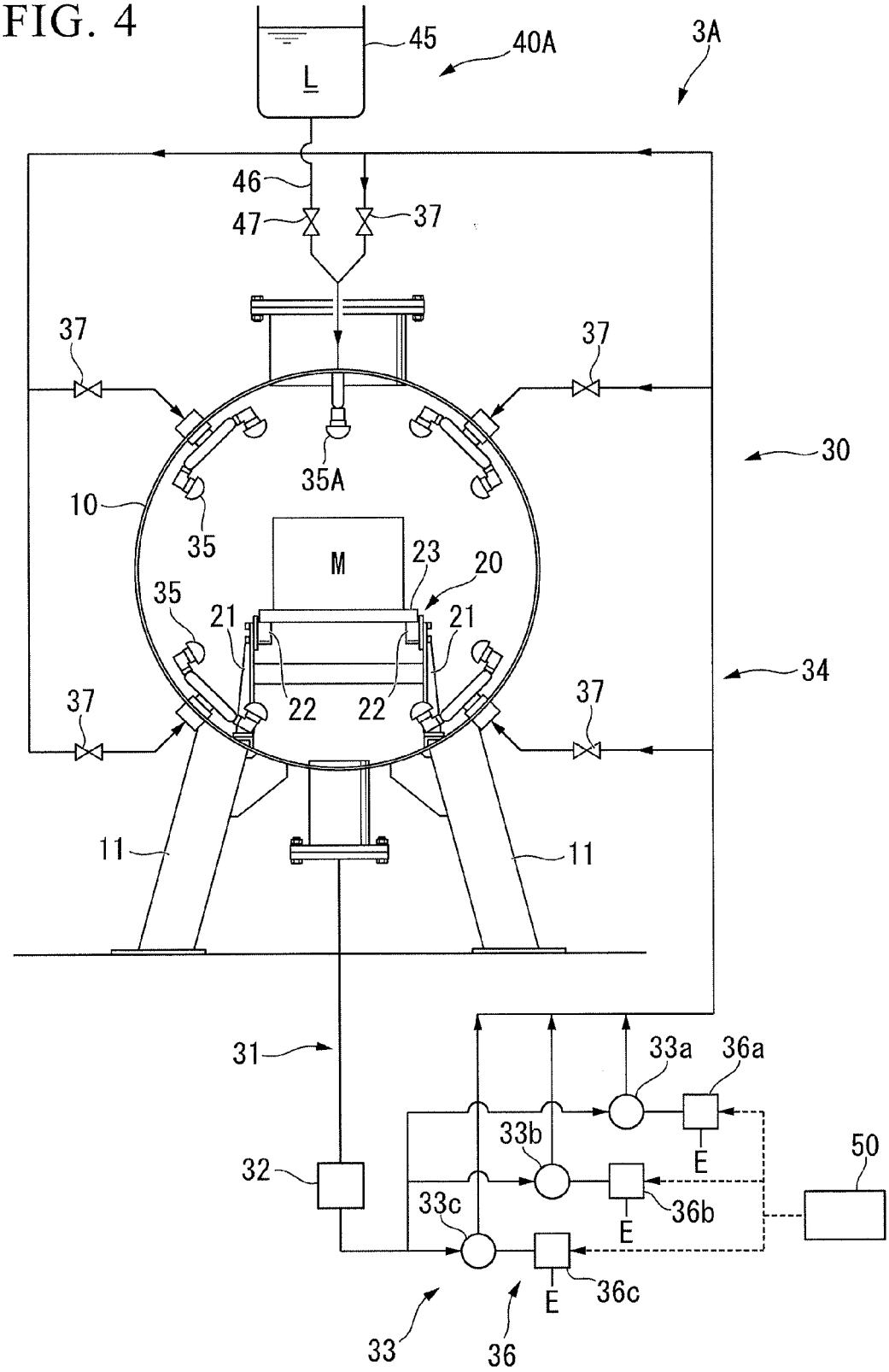
FIG. 4 is a schematic diagram of a cooling chamber in a second embodiment of the present invention, which is a cross-sectional view of FIG. 1 as viewed from section line A-A of FIG. 1.

FIG. 4 is a schematic diagram of the cooling chamber 3A in this embodiment. In addition, the cooling chamber 3A in FIG. 4 is a cross-sectional view as viewed from line A-A of FIG. 1. Further, in FIG. 4, the same elements as the constituent elements in the first embodiment shown in FIG. 2 are denoted by the same reference numerals and descriptions thereof are omitted.

The cooling chamber (a mist cooling apparatus) 3A in this embodiment is provided in the heat treatment apparatus 1, similarly to in the first embodiment. Further, a normally closed type valve 37 is connected to the supply pipe 34 which is connected to the upper nozzle 35A.

The cooling chamber 3A includes a second cooling system 40A. When supply of the electric power E to the cooling system 30 is stopped, the second cooling system 40A proceeds with cooling of the treatment object M. The second cooling system 40A includes a storage tank 45, a second supply pipe 46, and a second emergency valve 47.

The storage tank 45 is a tank that stores second cooling liquid (cooling fluid) L in the inside thereof. The storage tank 45 is provided above the upper side of the container 10 of the cooling chamber 3A. As the second cooling liquid L, water or the like can be used.

The second supply pipe 46 is a pipe member that is disposed in parallel with the valve 37 connecting to the upper nozzle 35A and connects the upper nozzle 35A and the storage tank 45. The second emergency valve 47 is connected to the second supply pipe 46. The second emergency valve 47 is a normally open type valve which adopts an opened state when supply of the electric power E is stopped. In addition, the second emergency valve 47 is always in a closed state while the electric power E is supplied.

Next, a cooling operation on the treatment object M by the second cooling system 40 when supply of the electric power E that operates the cooling system 30 is stopped is described with reference to FIG. 5. In addition, since a cooling operation on the treatment object M by the cooling system 30 is the same as that in the first embodiment, description thereof is omitted.

Figure 5:
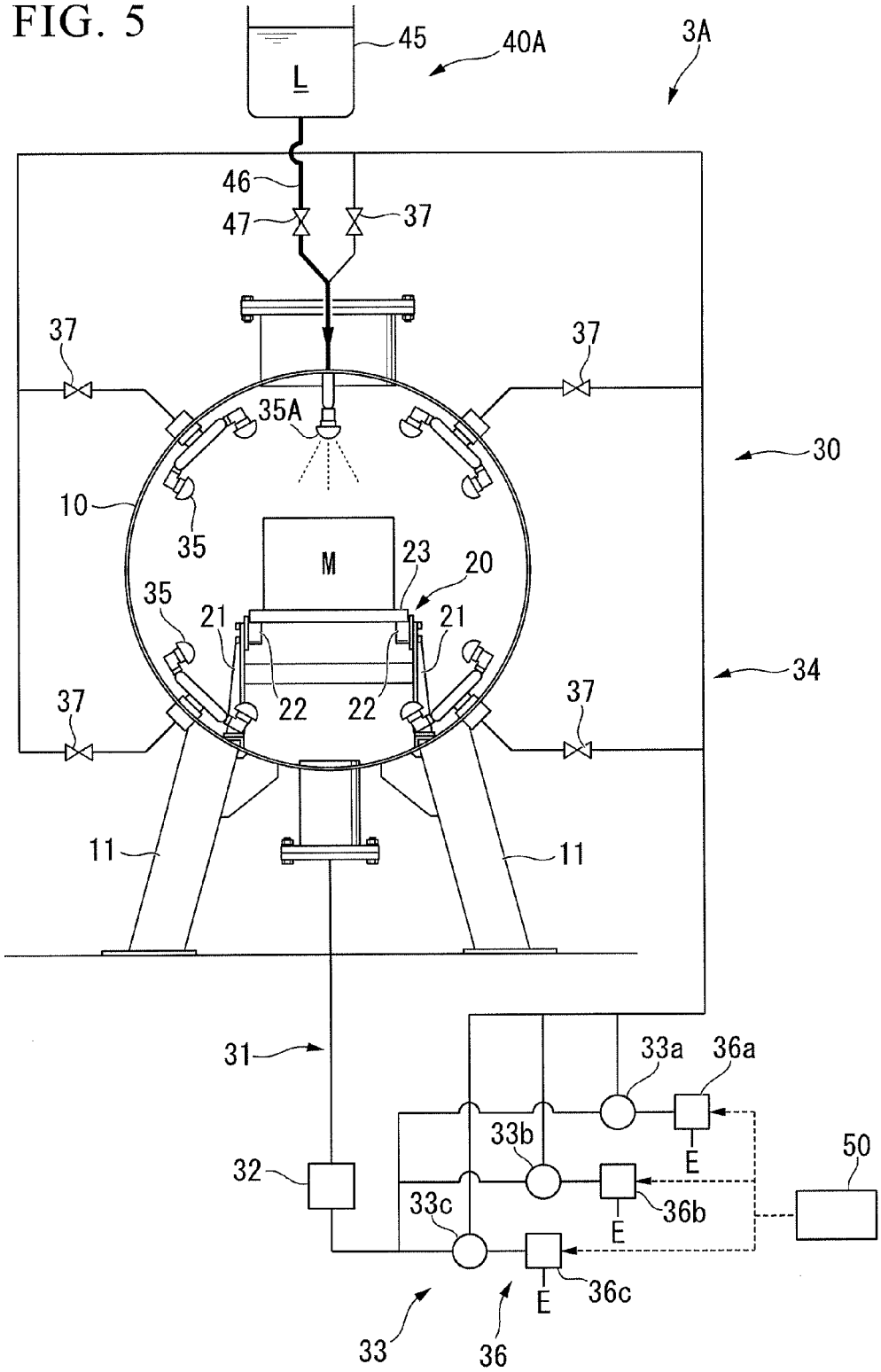
FIG. 5 is a schematic diagram showing an operation of a second cooling system in the second embodiment of the present invention.

FIG. 5 is a schematic diagram showing an operation of the second cooling system 40A in this embodiment. In addition, in the second supply pipe 46 shown in FIG. 5, only portions in which the second cooling liquid L flows during operation of the second cooling system 40A are shown by thick lines.

All the valves 37 which are provided in the supply pipe 34 adopt the closed states due to an outage of the electric power E. That is, in this embodiment, at the time of an outage of the electric power E, the cooling liquid does not flow in the cooling system 30.

On the other hand, the second emergency valve 47 adopts an opened state due to an outage of the electric power E. Accordingly, the second cooling liquid L flows toward the upper nozzle 35A through the second supply pipe 46 from the storage tank 45, and thus the second cooling liquid L is supplied toward the treatment object M from the upper nozzle 35A. In addition, since the storage tank 45 is provided above the upper side of the container 10, so that the second cooling liquid L is supplied to the treatment object M by using a difference in height (potential energy), a drive source for driving the second cooling system 40A is not required.

In addition, in this embodiment, since the second cooling liquid L in the storage tank 45 is discharged from the upper nozzle 35A by using a difference in height, there is a possibility that pressure required for spraying mist from the upper nozzle 35A may not be added to the second cooling liquid L, so that there is a possibility that the second cooling liquid L may not be sprayed in the form of mist. However, since the upper nozzle 35A is provided above the upper side of the treatment object M in the vertical direction with respect to the treatment object M, the second cooling liquid L can be reliably supplied to the treatment object M. Therefore, the second cooling liquid L is supplied toward the treatment object M from the upper nozzle 35A, so that cooling on the heated treatment object M is continued.

Therefore, according to this embodiment, the following effects can be obtained.

According to this embodiment, even if supply of the electric power E is stopped, so that cooling of the treatment object M by the cooling system 30 is stopped, the second cooling system 40A operates, so that it is possible to proceed with cooling of the treatment object M. Consequently, in a time of emergency such as an outage of the electric power E, damage to the cooling chamber 3A due to heat of the treatment object M can be prevented.

Preferred embodiments related to the present invention have been described above with reference to the accompanying drawings. However, the invention is not limited to the above embodiments. Various shapes, combinations, or the like of the respective members shown in the above embodiments are examples and various changes can be made based on design requirements or the like within a scope that does not depart from the gist of the invention.

For example, in the second embodiment, since the type of drive source of the cooling system 30 is not important, a drive source other than the electric power E is also acceptable. For example, the pump of the cooling system 30 may also be a device using an internal combustion engine or the like that is driven with fuel or the like as a drive source, and the second cooling system 40A may also be operated when supply of the fuel or the like is stopped. Further, the second cooling system 40A operates, not only when supply of a drive source is stopped, but when the recovery pipe 31 or the supply pipe 34 of the cooling system 30 is damaged, as long as the second supply pipe 46 is not damaged.

Further, in the second embodiment, since the second emergency valve 47 is a normally open type valve, until the second cooling liquid L in the storage tank 45 is exhausted, supply of the second cooling liquid L to the treatment object M is not stopped. For this reason, a configuration may also be adopted in which equipment to measure the level of the second cooling liquid L supplied into the container 10 is provided and the second emergency valve 47 is closed in a case where the liquid level reaches a prescribed liquid level. In this case, a drive source (a battery or the like) which drives the level-measuring equipment and the second emergency valve 47 may be required.

The invention claimed is:

1. A mist cooling apparatus comprising:

a first cooling system which operates when a drive source is operating and which includes:

nozzles that spray cooling liquid in a form of mist onto a treatment object, which has been heated and provided in a cooling furnace, and pumps that are driven by the drive source and thereby make the cooling liquid flow toward the nozzles, and a second cooling system which operates in response to a stoppage of the drive source, and thereby cools the treatment object, wherein:

the pumps are driven by electric power, the second cooling system includes an emergency power supply to drive only one pump among the pumps in response to an outage of the electric power, the second cooling system includes an emergency valve which is provided between the one pump and an upper nozzle among the nozzles, the upper nozzle being located over the treatment object, the emergency valve adopting an opened state at least during the outage of the electric power, the emergency valve is a normally open type valve, a normally closed type valve is provided between each pump among the pumps, other than the one pump, and a nozzle among the nozzles, other than the upper nozzle, the normally closed type valve adopting a closed state during the outage of the electric power, and the pumps, including the one pump, are driven by the drive source when the drive source is operating.

* * * * *